US007464422B2

(12) United States Patent
Townsend

(10) Patent No.: US 7,464,422 B2
(45) Date of Patent: Dec. 16, 2008

(54) INFLATABLE DEVICE FOR TURNING PEOPLE ON THEIR SIDE AND BACK AGAIN

(76) Inventor: Bobie Kenneth Townsend, 1504 Memorial Ln., Conroe, TX (US) 77304

( * ) Notice: Subject to any disclaimer, the term of this patent is extended or adjusted under 35 U.S.C. 154(b) by 0 days.

(21) Appl. No.: 11/480,684

(22) Filed: Jul. 3, 2006

(65) Prior Publication Data

US 2007/0006388 A1 Jan. 11, 2007

Related U.S. Application Data

(60) Provisional application No. 60/697,249, filed on Jul. 7, 2005.

(51) Int. Cl.
*A61G 7/057* (2006.01)

(52) U.S. Cl. ..... 5/615; 5/710; 5/715

(58) Field of Classification Search ..... 5/615, 5/710–713, 715, 662
See application file for complete search history.

(56) References Cited

U.S. PATENT DOCUMENTS

| | | | |
|---|---|---|---|
| 3,477,071 | A | 11/1969 | Emerson |
| 3,526,908 | A | 9/1970 | Davis |
| 3,775,781 | A | 12/1973 | Bruno et al. |
| 3,895,403 | A | 7/1975 | Davis |
| 3,962,736 | A | 6/1976 | Fedele |
| 4,272,856 | A | 6/1981 | Wegener et al. |
| 4,472,848 | A | 9/1984 | Newman |
| 4,502,169 | A | 3/1985 | Persson |
| 4,542,547 | A | 9/1985 | Sato |
| 4,617,690 | A | 10/1986 | Grebe |
| 4,654,903 | A | 4/1987 | Chubb et al. |
| 4,694,520 | A | 9/1987 | Paul et al. |
| 4,697,290 | A | 10/1987 | Alklind et al. |
| 4,768,249 | A | 9/1988 | Goodwin |
| 4,941,221 | A | 7/1990 | Kanzler |
| 4,947,500 | A | 8/1990 | Seiler |
| 4,953,247 | A | 9/1990 | Hasty |
| 4,977,629 | A | 12/1990 | Jones |
| 4,982,466 | A | 1/1991 | Higgins et al. |
| 4,986,738 | A | 1/1991 | Kawasaki et al. |
| 4,999,867 | A | 3/1991 | Toivio et al. |
| 5,005,231 | A | 4/1991 | Lonardo |
| 5,044,029 | A | 9/1991 | Vrzalik |
| 5,086,529 | A | 2/1992 | DeGroot |
| 5,090,077 | A | 2/1992 | Caden et al. |
| 5,092,007 | A | 3/1992 | Hasty |
| 5,095,568 | A | 3/1992 | Thomas et al. |
| 5,103,519 | A | 4/1992 | Hasty |
| 5,121,512 | A | 6/1992 | Kaufmann |
| 5,129,115 | A | 7/1992 | Higgins et al. |
| 5,142,719 | A | 9/1992 | Vrzalik |

(Continued)

FOREIGN PATENT DOCUMENTS

GB 2231790 A * 11/1990

*Primary Examiner*—Michael Trettel

(57) ABSTRACT

The present invention provides a portable device for rotating bed-ridden patients from their back to their side with little or no assistance from the care provider. The device comprises of a base material, a plurality of elongated air chambers interconnected on the base material consisting of five independent air chambers configured to lie beneath the patient in a secured manner that allows the air chambers to function between the patient and a bed like supporting surface. The device rotates the patient, functions as armrest, acts as a cushion support for the patient to lie against while on their side or on their back.

1 Claim, 4 Drawing Sheets

U.S. PATENT DOCUMENTS

| | | | | |
|---|---|---|---|---|
| 5,210,887 | A | | 5/1993 | Kershaw |
| 5,235,713 | A | | 8/1993 | Guthrie et al. |
| 5,325,551 | A | | 7/1994 | Tappel et al. |
| 5,375,273 | A | | 12/1994 | Bodine, Jr. et al. |
| 5,421,044 | A | | 6/1995 | Steensen |
| 5,530,974 | A | | 7/1996 | Rains et al. |
| 5,560,057 | A | | 10/1996 | Madsen et al. |
| 5,594,963 | A | | 1/1997 | Berkowitz |
| 5,659,905 | A | | 8/1997 | Palmer, Jr. et al. |
| 5,673,443 | A | | 10/1997 | Marmor |
| 5,745,942 | A | | 5/1998 | Wilkerson |
| 5,781,949 | A | | 7/1998 | Weismiller et al. |
| 5,956,787 | A | | 9/1999 | James et al. |
| 5,966,762 | A | | 10/1999 | Wu |
| 6,009,873 | A | | 1/2000 | Neviaser |
| 6,014,784 | A | | 1/2000 | Taylor et al. |
| 6,073,291 | A | | 6/2000 | Davis |
| 6,079,070 | A | * | 6/2000 | Flick ..... 5/715 |
| 6,085,372 | A | | 7/2000 | James et al. |
| 6,108,843 | A | | 8/2000 | Suzuki et al. |
| 6,119,292 | A | | 9/2000 | Haas |
| 6,154,900 | A | * | 12/2000 | Shaw ..... 5/81.1 R |
| 6,240,584 | B1 | | 6/2001 | Perez et al. |
| 6,282,737 | B1 | | 9/2001 | Vrzalik |
| 6,370,716 | B1 | | 4/2002 | Wilkinson |
| 6,393,636 | B1 | | 5/2002 | Wheeler |
| 6,560,793 | B2 | | 5/2003 | Walker |
| 6,604,252 | B1 | | 8/2003 | Lee et al. |
| 6,668,396 | B2 | | 12/2003 | Wei |
| 7,007,330 | B2 | | 3/2006 | Kuiper et al. |

* cited by examiner

INFLATABLE DEVICE FOR TURNING PEOPLE ON THEIR SIDE AND BACK AGAIN

CROSS REFERENCE TO RELATED APPLICATIONS

This application is based on provisional application Ser. No. 60/697,249, filed on Jul. 7, 2005.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of air support beds and more specifically to an air-supported device that performs the unassisted rotation of a patient giving therapeutic benefits.

When people become incapacitated they need help to lie on their side, to get in and out of bed and in extreme cases people are totally confined to bed and cannot move at all. Healthcare providers are necessary for the continued health of the bed-ridden patient. The patient's health depends on bodily movement of the patient on continual bases. When the body of a patient becomes dormant, pressure points on the body are assessable to bedsores and decubitus ulcers. To minimize the occurrence of bedsores and decubitus ulcers, healthcare providers must move the patient to different pressure point positions in a timely manner as recommended by a doctor. Some doctors as often as every two hours have required the patient's change in position. This continual physical stress on the healthcare providers has contributed to back injuries and muscle strains causing workers to call off sick leaving the other remaining healthcare providers to more overtime and even more physical stress and more likely to extend the time frame of each patient being moved. This invention provides the ability to move a bed-ridden patient to their side as easily as airing up a small air mattress. The design of the invention allows the patient to be moved slowly as not to jerk or pull on the skin of the patient or slide them on a bed sheet. It allows the healthcare provider to easily clean and medicate the patient, change the sheets on the bed and dress the patient without pulling, tugging or straining to get the job done or even waiting for assistance from a co-worker to move a plus size patient.

The health care industry is moving toward home care, where possible, to reduce cost. This device can be placed on a bed at a home to move a spouse or loved one by a family member or friend without the assistance of another. The bed-ridden patient could stay in their bed and be moved in a timely manner as required by a doctor.

Prior technology has strived to accomplish different functions needed in the medical field to help bed-ridden patients. Shifting the patient's pressure points helped reduce pressure ulcers (U.S. Pat. No. 3,477,071) (U.S. Pat. No. 4,272,856) (U.S. Pat. No. 4,694,520) (U.S. Pat. No. 4,697,290) (U.S. Pat. No. 5,325,551) (U.S. Pat. No. 5,956,787) (U.S. Pat. No. 5,966,762) (U.S. Pat. No. 6,014,784) (U.S. Pat. No. 6,073,291) (U.S. Pat. No. 6,108,843) (U.S. Pat. No. 6,240,584). Aids were conceived to help turn patients (U.S. Pat. No. 3,526,908) (U.S. Pat. No. 3,775,781) (U.S. Pat. No. 4,941,221). Some prior technology required large machines to accomplish the task (U.S. Pat. No. 4,502,169). Some were designed and developed as the bed itself (U.S. Pat. No. 4,542,547) (U.S. Pat. No. 4,654,903) (U.S. Pat. No. 4,768,249) (U.S. Pat. No. 4,953,247) (U.S. Pat. No. 5,044,029) (U.S. Pat. No. 5,090,077) (U.S. Pat. No. 5,095,568) (U.S. Pat. No. 5,103,519) (U.S. Pat. No. 5,142,719) (U.S. Pat. No. 5,235,713) (U.S. Pat. No. 5,560,057) (U.S. Pat. No. 5,594,963) (U.S. Pat. No. 5,781,949). Some were made for therapy purposes only (U.S. Pat. No. 4,617,690) (U.S. Pat. No. 4,947,500) (U.S. Pat. No. 4,999,867) (U.S. Pat. No. 5,086,529) (U.S. Pat. No. 5,121,512) (U.S. Pat. No. 5,129,115) (U.S. Pat. No. 5,421,044) (U.S. Pat. No. 6,085,372).

Other inventions either fall short of completely turning the patient to his/her side (U.S. Pat. No. 4,977,629) (U.S. Pat. No. 5,375,273) (U.S. Pat. No. 5,745,942) (U.S. Pat. No. 6,009,873) (U.S. Pat. No. 6,119,292) (U.S. Pat. No. 6,370,716) (U.S. Pat. No. 6,604,252) (U.S. Pat. No. 7,007,330) or slides the patient on the bed that could cause sheet burns during the move (U.S. Pat. No. 5,659,905) (U.S. Pat. No. 6,393,636) or the device is built in a way that it cannot be placed on an existing bed or modifying the bed in some manner (U.S. Pat. No. 6,282,737) (U.S. Pat. No. 6,668,396). Some depend on the strength of the healthcare provider to do the task (U.S. Pat. No. 3,962,736) (U.S. Pat. No. 4,472,848) (U.S. Pat. No. 5,005,231) (U.S. Pat. No. 5,530,974) (U.S. Pat. No. 6,560,793). Some accomplish the same task by using more air chambers or by dropping the patient down instead of the lift and turn system (U.S. Pat. No. 5,092,007). Some require a large area to maneuver the device to accomplish the task (U.S. Pat. No. 5,210,887).

There are a number of prior inventions that have the ability to turn patients that would reduce or eliminate pressure ulcers but fail to move the patient completely to the patient's side like the present invention. Very few inventions, if any, could be installed on an existing bed, whether at home or in a care facility, which could rotate a patient completely to their side like the present invention.

The present invention even allows the access for other inventions (U.S. Pat. No. 5,673,443) (U.S. Pat. No. 5,729,843) to be placed under patients while still in bed so that the patient can be lifted completely off the bed if necessary.

BRIEF SUMMARY OF THE INVENTION

The primary object of the invention is that the device moves patients from their back to their side and back again with little or no assistance from a care provider.

Another object of the invention is the device allows the sheets to be changed while the patient remains on the bed.

Another object of the invention is the device can be installed on any bed wide enough for the patients turning radius.

A further object of the invention is the device can change pressure points on patients by simply adding air to one or more of the air chambers.

Yet another object of the invention is that the device can create armrest on the bed.

Still yet another object of the invention is the armrest air chambers can be inflated as to enclose the patient to reduce patient's movement from side to side.

Another object of the invention is the two side air chambers can be inflated and deflated as to rock the patient for therapy.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, the present turning device serves to facilitate the therapeutic benefits by turning a bed-ridden patient as easily as inflating a small air mattress. The device consists of five separate interconnected elongated air chambers that contain interconnected material straps that restrict the ballooning effect of each air chamber. Support straps inside the air chambers create the correct angle to adjust the patient in the right position needed to complete the patient's turn.

The present invention has been designed to lift and turn the patient by inflating a side air chamber of the device to lift a patient to an appropriate angle of rotation, then the center air chamber inflates and gently pushes the back of the patient's torso until the patient's rotation is completed. When the process is competed the device only inflates to a height of approximately eight inches from the supported surface.

The end air chambers design was to be partially inflated during the patient's rotation to their side to create a bumper effect so the patient would lie against the inflated material instead of the bed rail. To assist the bed-ridden patient to return to their back, the end air chamber would be inflated further. At the same time the center & side air chamber is deflated which allows a slow, gentle and supported return to the patient's back. The end air chambers also serve as an armrest when inflated together or separately. Inflating both end air chambers together creates difficulty for a patient to turn over or climb out of bed. This could be done by direction of the physician if need be.

The side air chambers can be inflated together to raise the patient off the hard mattress and on to a bed of air. Inflating each side air chamber in an alternating sequence will roll the patient back and forth to stimulate the patient's kidneys and lymphatic system or help to break up accumulation of pulmonary fluids in a patient's lungs that may be suffering from trauma of surgery or other injury.

The design operation of the device allows for a simple pressure/vacuum pump that can be used for inflating air mattresses. A simple hose plug could be used to plug an inlet hose connected to a particular air chamber that was just inflated. A simple manifold could be created consisting of five 3-way valves or ten 2-way valves that could control the device by opening and/or closing the valves as needed. A manifold could be created consisting of electric solenoid valves that could be controlled by simple switches. Relay Boards could be utilized to energize and de-energize the electric solenoids allowing the device to be controlled by a microprocessor or manually by switches. Using this automated method would give the device the capability to move patients on a time schedule as required by a doctor to reduce or eliminate pressure ulcers.

Further objects and advantages of this present invention will become apparent from a consideration of the drawings and ensuing description.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Referring now in detail to the drawings, therein illustrated is a preferred embodiment of a novel inflatable device for turning people on their side and back again system of the present invention.

Figure 6:
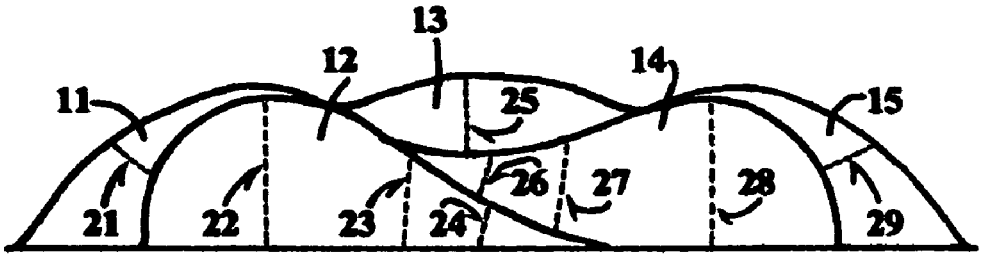
FIG. 6 is a perspective view of the invention with the Right End Chamber partially inflated, the Right Side Chamber inflated, the Center Chamber partially inflated, the Left Side Chamber inflated, and the Left End Chamber partially inflated.

Referring to FIG. 6 shows the operational design of the five air chambers of the inflatable device for turning people on their side and back again. The five interconnected air chambers comprising of the Right End Chamber 11, the Right Side Chamber 12, the Center Chamber 13, the Left Side Chamber 14, and the Left End Chamber 15 are the major components of the device. The plurality of elongated air chambers inflated shape are held by a series of support straps made of the same material as the air chambers. Twelve mils thick polyurethane material has been used with good results. The support straps can either be a series of independent straps or one continues strap the length of the particular elongated air chamber.

Figure 4:
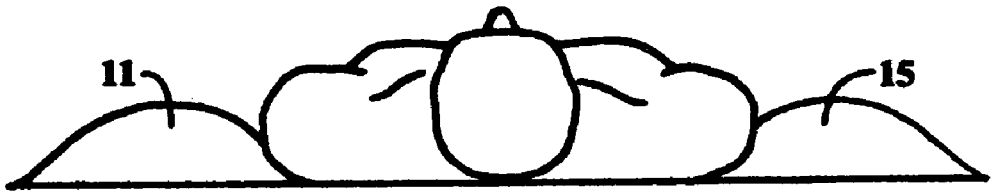
FIG. 4 is a perspective view of the invention with the Right End Chamber inflated and the Left End Chamber inflated.

The Right End Chamber support strap 21 will be sealed as to allow the Right End Chamber 11 to inflate in a dome shape to an approximate five inches in height. The support strap 21 is sealed as to hold the Right End Chamber 11 in an up and down vertical position as shown in FIG. 4.

FIG. 6 shows the Right Side Chamber 12 containing a minimum of three separate support straps in different lengths that will be sealed as to allow the Right Side Chamber 12 to inflate in a triangular shape to obtain the appropriate angle for therapy purposes and to obtain different pressure points on the patient. The longest support strap 22 will be sealed at approximately 60% of the width of the air chamber material from the pivot point to allow that portion of the Right Side Chamber 12 to expand to approximately eight inches. The middle support strap 23 will be sealed at approximately 33% of the width of the air chamber material from the pivot point to allow that portion of the Right Side Chamber 12 to expand to approximately five inches. The shortest support strap 24 will be sealed at approximately 15% of the width of the air chamber material from the pivot point to allow that portion of the Right Side Chamber 12 to expand to approximately three inches creating the triangular effect when inflated.

The Center Chamber support strap 25 will be sealed as to allow the Center Chamber 13 to inflate in a dome shape to an approximate five inches in height. The support strap 25 is sealed as to hold the Center Chamber 11 in a up and down vertical position as shown in FIG. 6, but the Center Chamber 11 is design to inflate at an angle according to which side air chamber is inflated.

The Left Side Chamber 14 contain a minimum of three separate support straps in different lengths that will be sealed as to allow the Left Side Chamber 14 to inflate in a triangular shape to obtain an appropriate angle for therapy purposes and to obtain different pressure points on the patient. The longest support strap 28 will be sealed at approximately 60% of the width of the air chamber material from the pivot point to allow the Left Side Chamber 14 to expand to approximately eight inches. The middle support strap 27 will be sealed at approximately 33% of the width of the air chamber material from the pivot point to allow that portion of the Left Side Chamber 14 to expand to approximately five inches. The shortest support strap 26 will be sealed at approximately 15% of the width of the air chamber material from the pivot point to allow that portion of the Left Side Chamber 14 to expand to approximately three inches creating the triangular effect when inflated.

The Left End Chamber support strap 29 will be sealed as to allow the Left End Chamber 15 to inflate in a dome shape to an approximate five inches in height. The support strap 29 is sealed as to hold the Right End Chamber 15 in an up and down vertical position as shown in FIG. 4.

Figure 7:
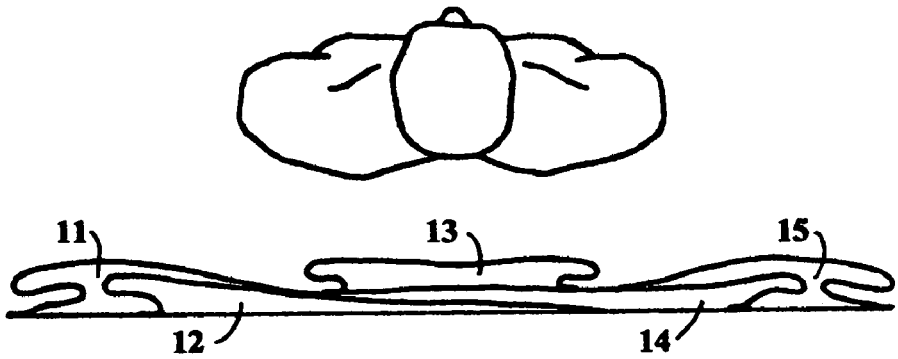
FIG. 7 is a perspective view of the invention with the Chambers partially inflated to show the fold of the material when sealed.
Figure 8:
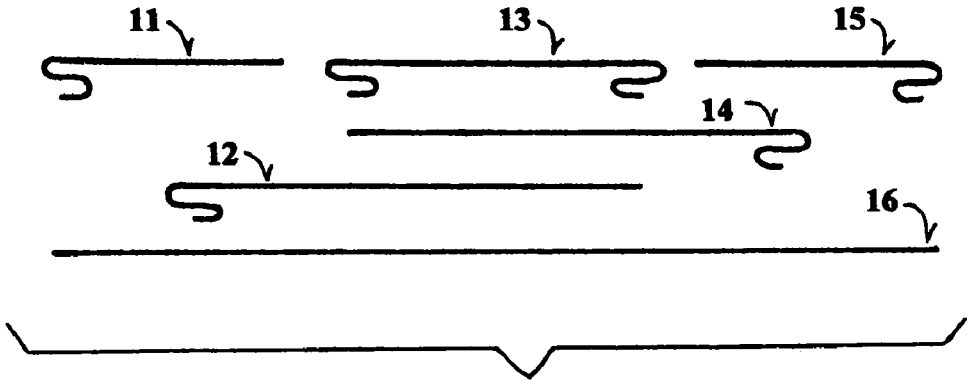
FIG. 8 is an exploded view of the invention showing approximate location to other material when sealed.

Referring now in further detail as to the preferred folding of the material that forms the individual air chambers as shown in FIG. 7 and FIG. 8. The folds of the material when sealed allow the deflation of the air chambers to be flat as possible. FIG. 8 indicates the position of each major piece of material and its relationship to the other pieces of material that create the device. FIG. 7 shows the material sealed and the air chambers in a partially inflated state.

Referring to FIG. 8 and lowering the Right Side Chamber material 12 on to the Base material 16 would indicate the right and left seal points of the Left Side Chamber 12 would be sealed upon the Base material 16. Lowering the Left Side Chamber material 14, the right seal point will come in contact with the Right Side Chamber material 12 and the left seal point will come in contact with the Base material 16. Lowering in the Right End Chamber material 11, the right seal point will come in contact with the Base material 16 and the left seal point will come in contact with the Right Side Chamber material 12. Lowering the Center Chamber material 13, the right and left seal point will come in contact with the Left Side Chamber material 14. Lowering the Left End Chamber material 15, the right seal point will come in contact with the Left Side Chamber material 14 and the left seal point will come in contact with the Base material 16. When all seal points of each air chamber material are attached, the unit will conform in a fashion as indicated in FIG. 7.

Figure 9:
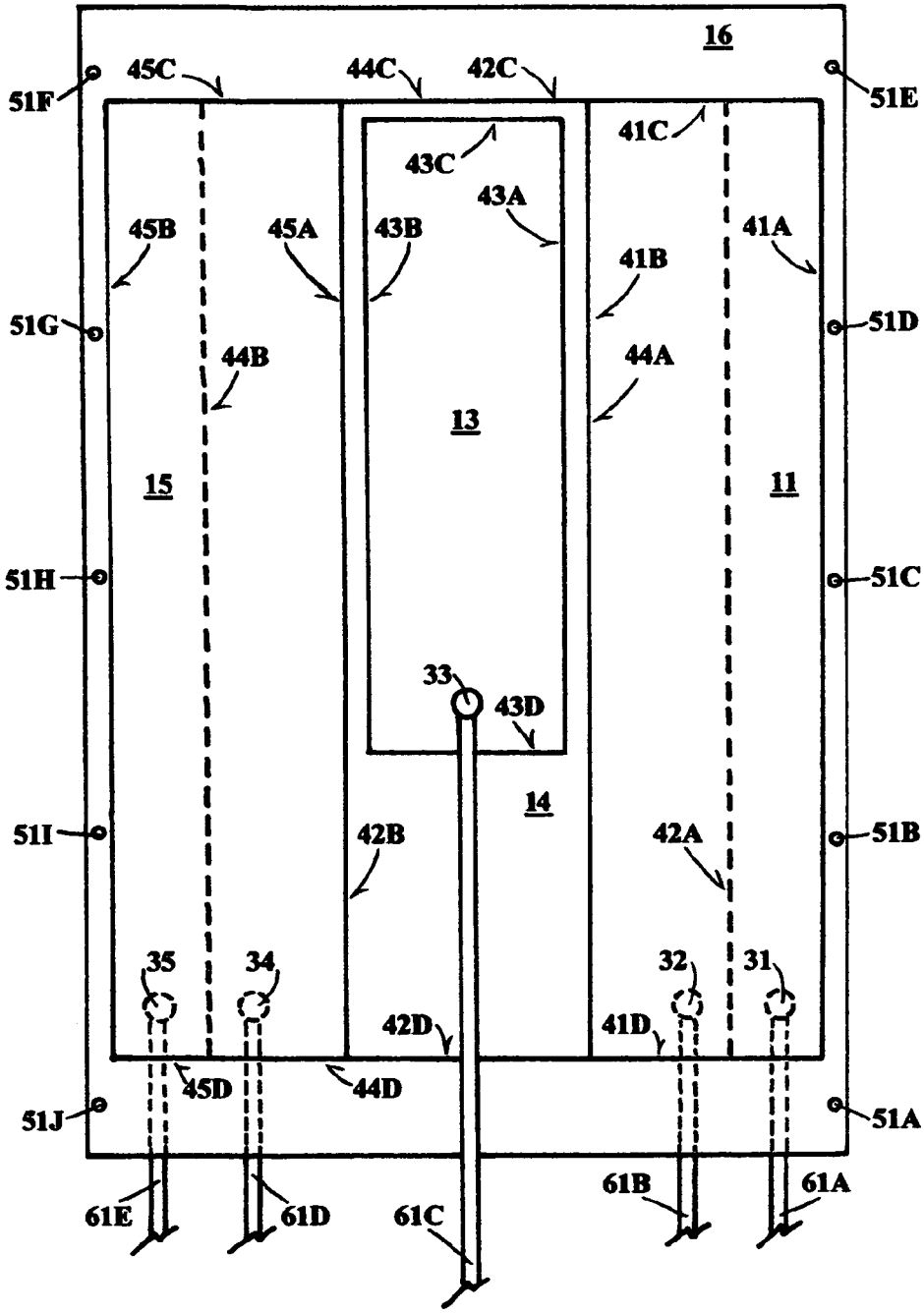
FIG. 9 is a plain view of the invention showing the sealing points of the material.

Referring to FIG. 9 indicates a plain view of the location of major components of the inflatable device for turning people on their side and back again. The Base material 16 will be attached to the support unit of where the patient will lie. Grommets 51A-51J will be installed on the Base material 16 as a mean to secure the device upon the support unit where the patient will lie.

An inlet/outlet port 35 is installed as a means to inflate and deflate the Left End Chamber 15 by way of tubing 61E routed underneath the Base material 16. An inlet/outlet port 34 is installed as a means to inflate and deflate the Left Side Chamber 14 by way of tubing 61D routed underneath the Base material 16. An inlet/outlet port 33 is installed as a means to inflate and deflate the Center Chamber 13 by way of tubing 61C routed on top of the device. The tubing 61C can be enclosed with material, but it is not necessary since the device should be covered by a expandable sheet on the bed. The inlet/outlet port 33 will be located just below the buttocks and between both legs of the patient. An inlet/outlet port 32 is installed as a means to inflate and deflate the Right Side Chamber 14 by way of tubing 61B routed underneath the Base material 16. An inlet/outlet port 31 is installed as a means to inflate and deflate the Right End Chamber 11 by way of tubing 61A routed underneath the Base material 16. The tubing diameter should be large enough to supply two or more cubic feet per minute of air at three p.s.i.g. pressure.

The right seal point 41A of the Right End Chamber 11 is located on the Base material 16. The left seal point 41B of the Right End Chamber 11 is located on the Right Side Chamber 12. The upper most seal 41C of the Right End Chamber 11 is located on the Base material 16. The lower most seal 41D of the Right End Chamber 11 is located on the Base material 16. The right seal point 42A of the Right Side Chamber 12 is located on the Base material 16. The patient's shoulder should not lie passed the right seal point 42A of the Right Side Chamber 12. The left seal point 42B of the Right Side Chamber 12 is located on the Base material 16. The left seal point 42B is the pivot point of the Right Side Chamber 14 and will be located near the ribcage of the patient. The upper most seal point 42C of the Right Side Chamber 12 is located on the Base material 16. The lower most seal point 42D of the Right Side Chamber 12 is located on the Base material 16. The right seal point 43A of the Center Chamber 13 is located on the Left Side Chamber 14. The left seal point 43B of the Center Chamber 13 is located on the Left Side Chamber 14. The upper most seal point 43C of the Center Chamber 13 is located on the Left Side Chamber 14. The upper most seal point 43C of the Center Chamber 13 will be located near the lower neck area of the patient. The lower most seal point 43D of the Center Chamber 13 is located on the Left Side Chamber 14. The right seal point 44A of the Left Side Chamber 14 is located on the Right Side Chamber 12. The right seal point 44A is the pivot point of the Left Side Chamber 14 and will be located near the ribcage of the patient. The left seal point 44B of the Left Side Chamber 14 is located on the Base material 16. The patient's other shoulder should not lie passed the left seal point 44B of the Left Side Chamber 14. The upper most seal point 44C of the Left Side Chamber 14 is located on the Base material 16. The lower most seal point 44D of the Left Side Chamber 14 is located on the Base material 16. The right seal point 45A of the Left End Chamber 15 is located on the Left Side Chamber 14. The left seal point 45B of the Left End Chamber 15 is located on the Base material 16. The upper most seal 45C of the Left End Chamber 15 is located on the Base material 16. The lower most seal 45D of the Left End Chamber 15 is located on the Base material 16.

Figure 1:
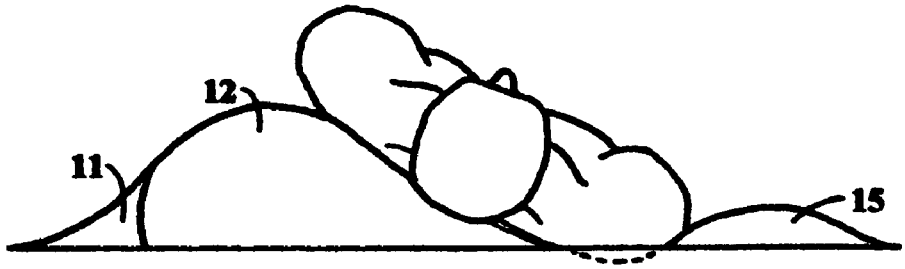
FIG. 1 is a perspective view of the invention with the Right Side Chamber inflated and the Left End Chamber partially inflated.
Figure 2:
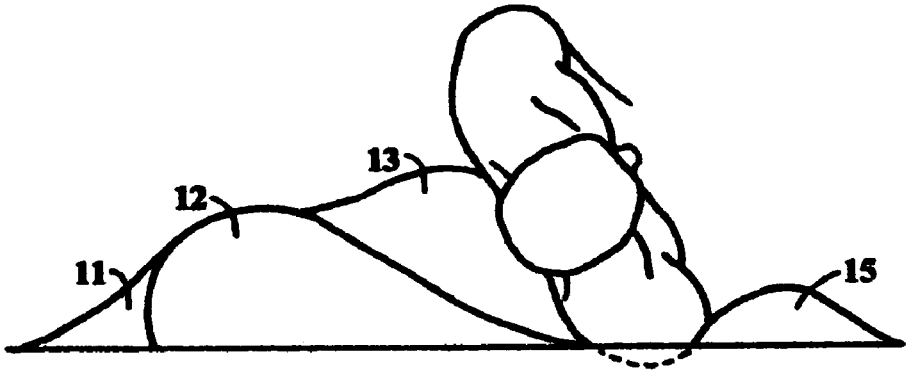
FIG. 2 is a perspective view of the invention with the Right Side Chamber inflated, the Center Chamber partially inflated and the Left End Chamber partially inflated.
Figure 3:
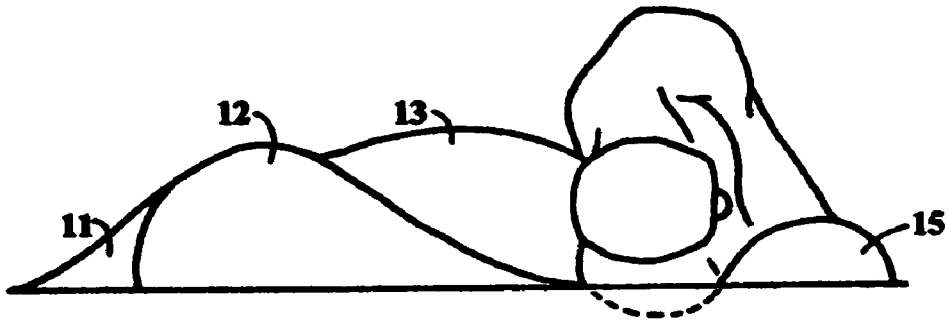
FIG. 3 is a perspective view of the invention with the Right Side Chamber inflated, the Center Chamber inflated and the Left End Chamber partially inflated.

The operation of the inflatable device for turning people on their side and back again is illustrated by referring to FIG. 1, FIG. 2, and FIG. 3. Referring to FIG. 1 shows the Right Side Chamber 12 fully inflated placing the patent at an appropriate angle used for therapy purposes and to obtain different pressure points on the patient. The Right End Chamber 11 shows the deflated material following the expansion of the Right Side Chamber 12 while the Right Side Chamber is inflated. The Left End Chamber 15 has been partially inflated creating a bumper effect as the patents turns toward the bed rail.

Referring to FIG. 2 shows the Right Side Chamber 12 fully inflated as the deflated Right End Chamber 11 extend forward. The Center Chamber 13 is partially inflated illustrating the movement of the patent toward his side. Without further inflation of the Left End Chamber 15, the air is squeezed toward the bed rail by the patient's movement.

Referring to FIG. 3 shows the Right Side Chamber 12 fully inflated as the deflated Right End Chamber 11 extend forward. The Center Chamber 13 is fully inflated illustrating the completion of the turn of the patent toward his side. Without further inflation of the Left End Chamber 15, the air is squeezed toward the bed rail by the patient's movement creating a bumper effect allowing the patient to lie against the inflated material instead of the bed rail. To return the patient to his back, the Left End Chamber 15 is inflated further causing force upon the side of the patient to return to his back. The Center Chamber 13 is then deflated; afterwards the Right Side Chamber 12 is deflated completing the rotation of the patient to his back. The Left End Chamber 15 then can be deflated to place the device back in its original position. To move the patient to his left side, the care provider would utilize the Left Side Chamber instead of the Right Side Chamber and utilize the Right End Chamber instead of the Left End Chamber. All other functions would be the same.

Referring to FIG. 4 shows the Right End Chamber 11 and the Left End Chamber 15 fully inflated to create armrest or to confine the patient from moving from side to side or to discourage the patient from getting easily out of bed.

Figure 5:
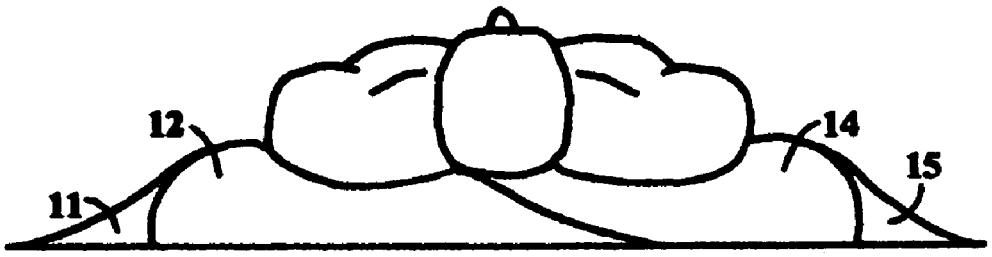
FIG. 5 is a perspective view of the invention with the Right Side Chamber partially inflated and the Left Side Chamber partially inflated.

Referring to FIG. 5 shows the Right Side Chamber 12 and the Left Side Chamber 14 partially inflated as to raise the patient off of the supporting surface. Both, the deflated Right End Chamber 11 and Left End Chamber 15 extend only as the side air chambers inflate.

Consequently, the inflatable device for turning people on their side and back again of the present invention provides many benefits over the prior art. The Center Chamber 13 is uniquely placed as to perform the same function whether the Right Side Chamber 12 or the Left Side Chamber 14 is inflated and functions by utilizing a low expansion height when operated. While the above descriptions contain much specificity, these should not be construed as limitations on the scope of the invention, but rather as an exemplification of one preferred embodiment thereof. Many other variations are possible.

Accordingly, the scope of the present invention should be determined not by the embodiments illustrated above, but by the appended claims and their legal equivalents.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An inflatable device for turning an object, positioned generally in the center of the device, on its side and back again comprising:

a base material having a first and second edge and a top and bottom edge and a generally longitudinal center line; and a first side air chamber and a second side air chambers, each side air chamber having a first and second edge and a top and bottom edge, the first side air chamber is connected at its first and second edges to the base material, each on opposite sides of the center line, the second side air chamber connected at the first edge to the base material and at the second edge to the first side air chamber, the top and bottom edge of the first and second side air chamber is connected to the base material; and a center air chamber having a first and second edge and a top and bottom edge, the first edge connected to the second side air chamber on one side of the center line to generally near the side of the object and the second edge connected to the second side air chamber on the opposite side of the center line to generally near the other side of the object, the top and bottom edge of the center air chamber is connected to the second side air chamber across both sides of the center line; and a left end air chamber having a right edge and a left edge and a top and bottom edge, the left edge of which is connected to the base material and the right edge of which is connected to either the first side air chamber or the second side air chamber, the left end air chamber is positioned generally from about the left edge of the base material to generally the left side of the object, the top and bottom edge of the left end air chamber is connected to the base material; and a right end air chamber having a right edge and a left edge and a top and bottom edge, the right edge of which is connected to the base material and the left edge of which is connected to either the first side air chamber or the second side air chamber, the right end air chamber is positioned generally from about the right edge of the base material to generally the right side of the object, the top and bottom edge of the right end air chamber is connected to the base material.

* * * * *